US008676079B2

(12) United States Patent
Nakamura et al.

(10) Patent No.: US 8,676,079 B2
(45) Date of Patent: Mar. 18, 2014

(54) OPERATING DEVICE, INFORMATION PROCESSING APPARATUS, AND IMAGE FORMING APPARATUS

(75) Inventors: Yasushi Nakamura, Osaka (JP); Hiroyuki Nagao, Osaka (JP); Hidenobu Mandai, Osaka (JP); Yoshiya Kinoshita, Osaka (JP); Kazuhiro Matsuyama, Osaka (JP); Kazuhisa Yoneda, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 258 days.

(21) Appl. No.: 13/091,406

(22) Filed: Apr. 21, 2011

(65) Prior Publication Data

US 2011/0262172 A1 Oct. 27, 2011

(30) Foreign Application Priority Data

Apr. 26, 2010 (JP) ..... 2010-100462

(51) Int. Cl.
*G03G 15/00* (2006.01)

(52) U.S. Cl.
USPC ..... 399/81; 248/923

(58) Field of Classification Search
USPC ..... 399/81; 248/922, 923
See application file for complete search history.

(56) References Cited

U.S. PATENT DOCUMENTS

| | | | | |
|---|---|---|---|---|
| 6,108,868 | A * | 8/2000 | Lin | 16/340 |
| 2006/0219852 | A1 * | 10/2006 | Kawai et al. | 248/213.1 |
| 2009/0142095 | A1 | 6/2009 | Nishizawa | |
| 2009/0169242 | A1 * | 7/2009 | Akiyama | 399/107 |
| 2009/0212184 | A1 * | 8/2009 | Bourgeois et al. | 248/288.11 |

FOREIGN PATENT DOCUMENTS

| | | | |
|---|---|---|---|
| JP | 2007-127846 | A | 5/2007 |
| JP | 2008-096467 | A | 4/2008 |
| JP | 2009-139434 | A | 6/2009 |

* cited by examiner

*Primary Examiner* — Benjamin Schmitt
(74) *Attorney, Agent, or Firm* — Renner, Otto, Boisselle & Sklar, LLP

(57) ABSTRACT

An operating device includes a first support frame, a support shaft, an operating panel, a second support frame, and a spring. The first support frame is fixed to a front side of a main apparatus. The support shaft projects from the first support frame in a widthwise direction of the main apparatus. The second support frame is pivotally supported on the support shaft in such a manner as to be displaceable within a predetermined range in the widthwise direction while supporting the operating panel. The spring biases the second support frame in a first direction which the second support frame is pressed against the first support frame. The first support frame has a plurality of recesses on a circumference of a circle that is concentric with the support shaft. The second support frame has a first projection capable of being engaged into any one of the recesses.

9 Claims, 9 Drawing Sheets

OPERATING DEVICE, INFORMATION PROCESSING APPARATUS, AND IMAGE FORMING APPARATUS

CROSS REFERENCE

This Nonprovisional application claims priority under 35 U.S.C. §119(a) on Patent Application No. 2010-100462 filed in Japan on Apr. 26, 2010, the entire contents of which are hereby incorporated by reference.

BACKGROUND OF THE INVENTION

The present invention relates to an operating device to be mounted on a front side of a main apparatus, as well as an information processing apparatus and an image forming apparatus which are each provided with such an operating device.

An information processing apparatus, such as an image forming apparatus or the like, includes a main apparatus and an operating device for receiving an entry of an operation for controlling the main apparatus. It has been a conventional practice to fix such an operating device to the main apparatus. In recent years, however, demands exist for an operating device having an operating panel of which the angle of inclination can be varied to an angle desired by the user in accordance with the standing position of the user and the height of the user's eyes for the convenience of not only physically unimpaired persons but also physically impaired persons including wheel chair users.

In view of such demands, one known operating device has an operating panel which becomes free to pivot when an unlock button is depressed to unlock the operating panel positioning lock, as described in Japanese Patent Laid-Open Publication No. 2007-127846 for example.

Another known operating device has an arrangement wherein: the angle of inclination of an operating panel can be maintained by frictional engagement force exerted between a frictional member provided on a main apparatus and a support shaft provided on the operating panel by pressing the frictional member against the support shaft; and the frictional member can be released from the state of pressing against the support shaft by pressing an operating lever to allow the operating panel to pivot, as described in Japanese Patent Laid-Open Publication No. 2008-096467 for example.

With such conventional operating devices, however, the user has to perform the unlocking operation by depressing the unlock button or pressing the operating lever with his or her first hand while holding the operating panel with the second hand to prevent the operating panel from pivoting down by its own weight and then perform the locking operation by the first hand while keeping the operating panel at a desired angle of inclination with the second hand. Thus, the conventional operating devices require that the both hands of the user should be used to vary the angle of inclination of the operating panel and hence are poor in operability.

A feature of the present invention is to provide an operating device which allows the user to vary the angle of inclination of the operating panel with one hand, as well as an information processing apparatus and an image forming apparatus which are each provided with such an operating device.

SUMMARY OF THE INVENTION

An operating device includes a first support frame, a support shaft, an operating panel, a second support frame, and an elastic member. The first support frame is fixed to a front side of a main apparatus. The support shaft is supported by the first support frame in such a manner as to project in a widthwise direction of the main apparatus. The operating panel is configured to receive an entry of an operation for controlling the main apparatus. The second support frame is pivotally supported on the support shaft in such a manner as to be displaceable within a predetermined range in the widthwise direction while supporting the operating panel. The elastic member exerts an elastic force on the second support frame in a first direction in which the second support frame is pressed against the first support frame. The first support frame has a plurality of recesses on a circumference of a circle that is concentric with the support shaft. The second support frame has a surface pressed against the first support frame which is provided with a first projection capable of being engaged into any one of the recesses.

In this construction, the second support frame, which is pivotally supported on the support shaft, can pivot to vary the angle of inclination thereof and can be displaced within the predetermined range in the widthwise direction of the main apparatus. Since the elastic force is exerted on the second frame in the first direction in which the second support frame is pressed against the first support frame, the first projection of the second support frame, when in an angular position to fit in any one of the recesses of the first support frame, becomes engaged into that recess thereby maintaining the angle of inclination of the second support frame. On the other hand, the angle of inclination of the second support frame can be varied by the following operations. That is, the first projection is disengaged from the recess by displacing the second support frame in a direction opposite to the first direction against the elastic force of the elastic member with one hand of the user, so that the second support frame becomes free to pivot. The first projection can be engaged into a desired one of the recesses by an operation including pivoting the second support frame to a desired angle with the hand while keeping the second support frame displaced in the direction opposite to the first direction and then allowing the second support frame to be displaced in the first direction by the elastic force of the elastic member. By so doing, the second support frame can be maintained at a desired angle of inclination. In this way, a series of operations for varying the angle of inclination of the second support frame, including disengaging the first projection from the recess, pivoting the second support frame, and then engaging the first projection into a desired one of the recesses, can be achieved with only one hand holding the second support frame. Thus, the present invention enables the angle of inclination of the operating panel to be varied with one hand.

DETAILED DESCRIPTION OF THE INVENTION

Hereinafter, an embodiment of the present invention will be described with reference to the drawings.

Figure 1:
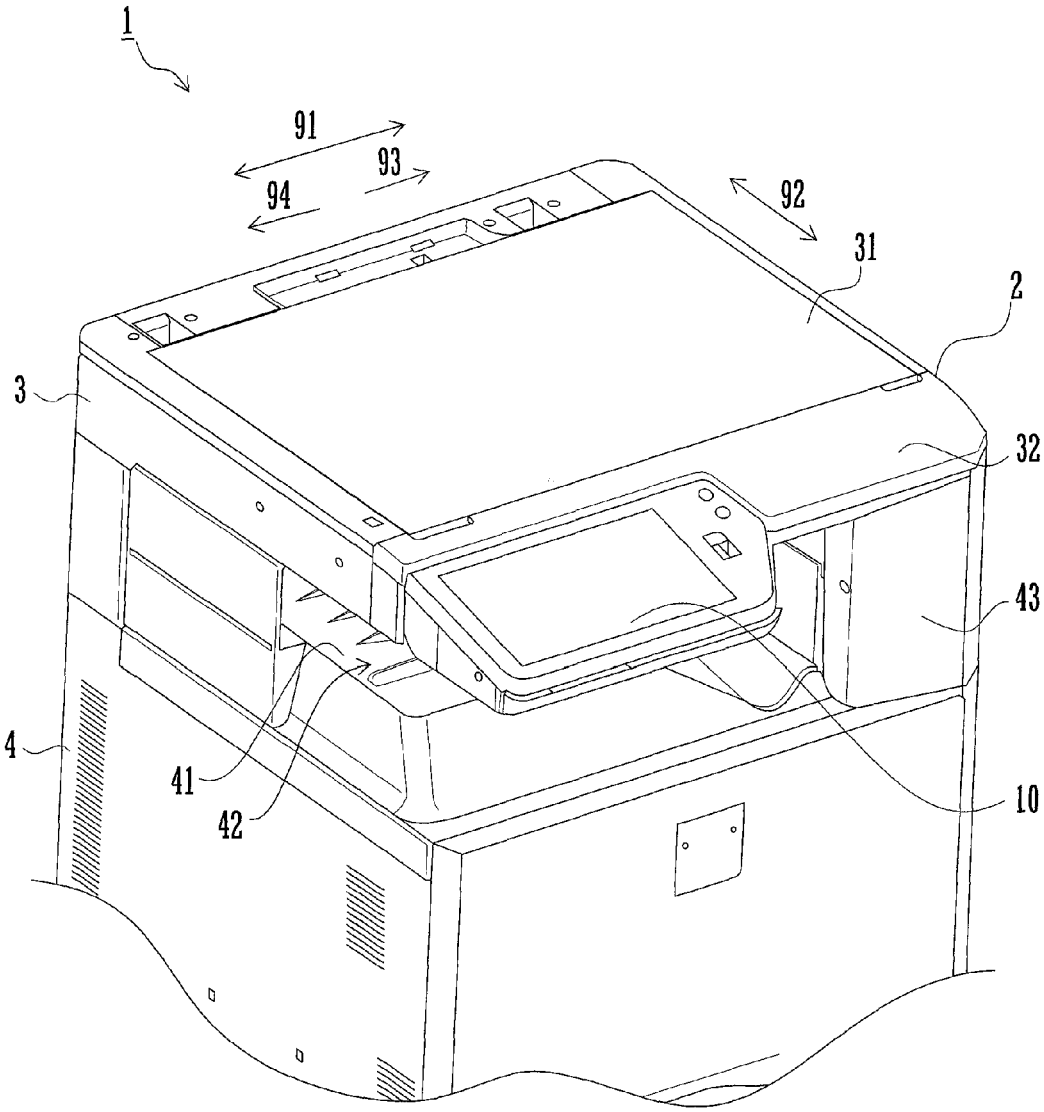
FIG. 1 is a fragmentary perspective view illustrating an image forming apparatus provided with an operating device according to an embodiment of the present invention.
Figure 2A:
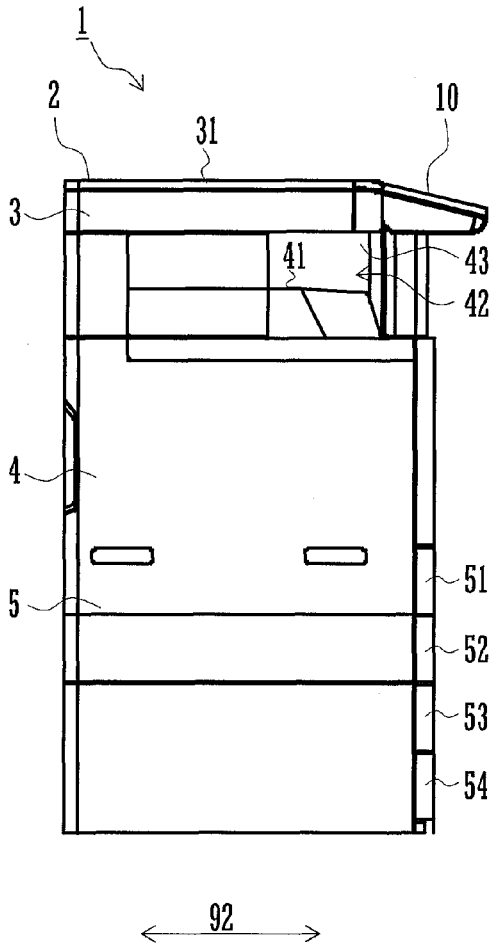
FIG. 2A is a side elevational view of the image forming apparatus with an operating panel positioned horizontally.
Figure 2B:
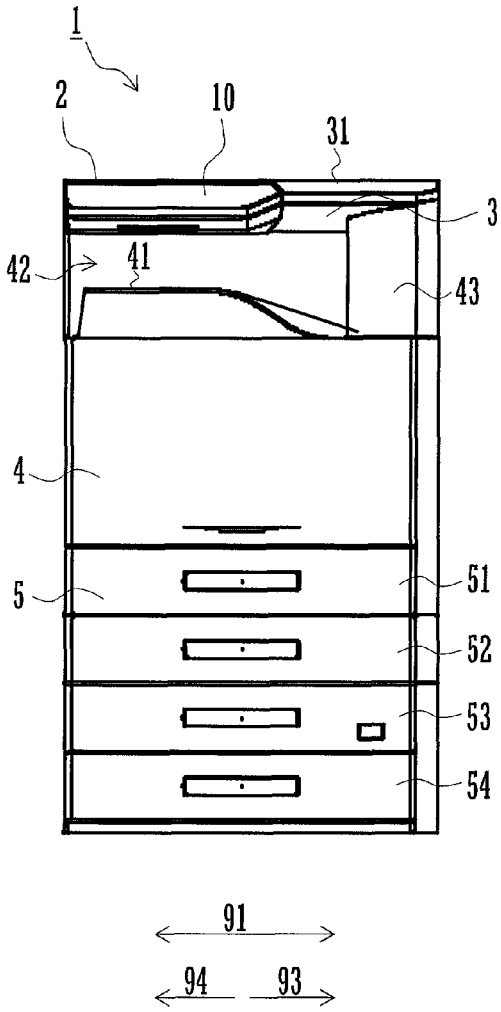
FIG. 2B is a front elevational view of the image forming apparatus shown in FIG. 2A.

Referring to FIGS. 1, 2A and 2B, an image forming apparatus 1 as an exemplary information processing apparatus includes a main apparatus 2 and an operating device 10.

The main apparatus 2, which is of the so-called "in-body output type", includes an image reading section 3, an image forming section 4, and a sheet feeding section 5.

Figure 3A:
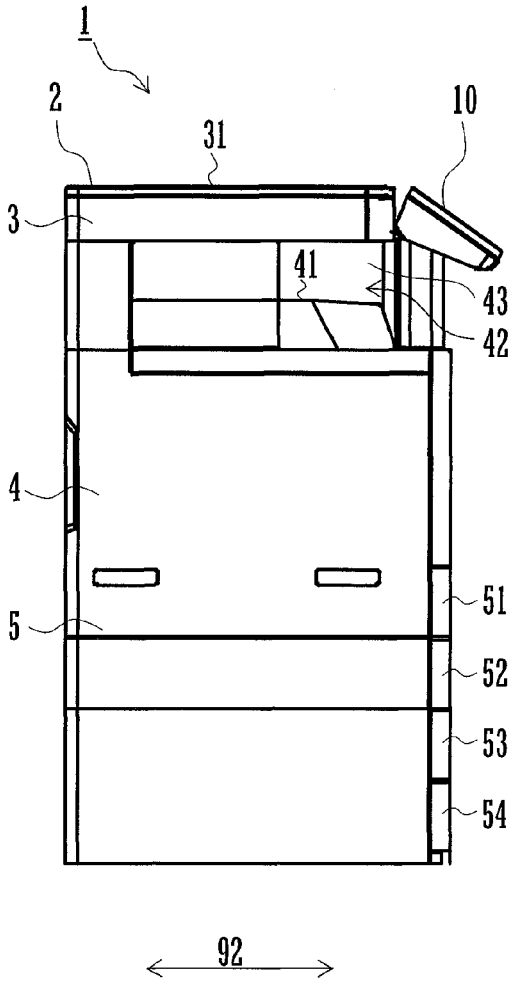
FIG. 3A is a side elevational view of the image forming apparatus with the operating panel inclined on the front side of the image forming apparatus.
Figure 3B:
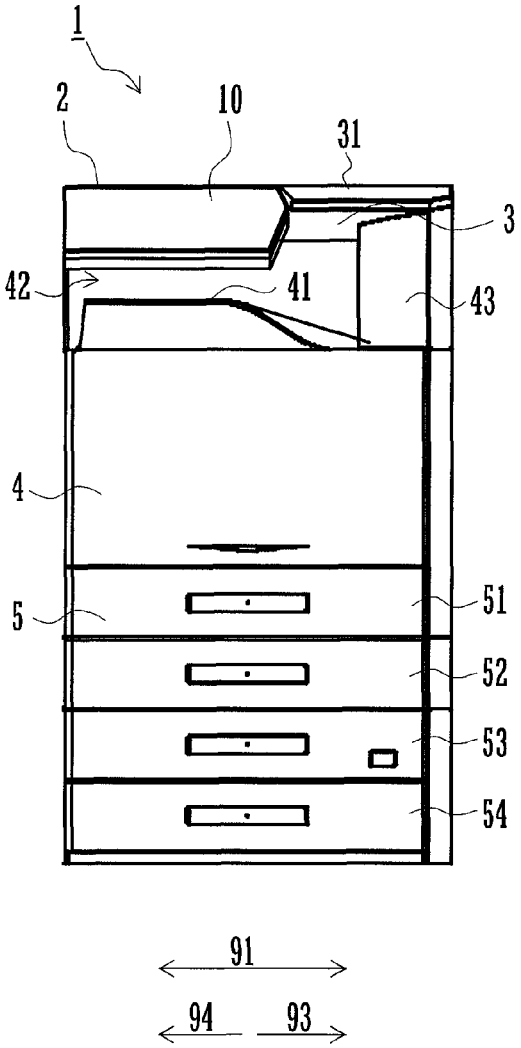
FIG. 3B is a front elevational view of the image forming apparatus shown in FIG. 3A.

The image reading section 3 is disposed in an upper portion of the main apparatus 2. The image reading section 3 is configured to carry out an image reading process including applying light to a document placed on a document platen 31 and reading an image from the document based on reflected light to generate image data. Note that a cover member for covering and exposing the top surface of the document platen 31 is omitted from FIGS. 1, 2A and 2B. The cover member is omitted from FIGS. 3A and 3B also.

The sheet feeding section 5 is disposed in a lower portion of the main apparatus 2 and has a plurality of sheet feed cassettes 51 to 54. The sheet feed cassettes 51 to 54 each hold recording sheets as exemplary recording media. The sheet feeding section 5 is configured to feed recording sheets one by one to the image forming section 4.

The image forming section 4 is disposed under the image reading section 3 and configured to perform image formation on each recording sheet. The image forming section 4 is formed with a sheet output section 43 at a first end portion of the main apparatus 2 in widthwise directions 91 of the main apparatus 2 in such a manner as to leave a space 42 under the image reading section 3 for accommodating therein a sheet output tray 41 configured to receive recording sheets finished with image formation. The image forming section 4 outputs such recording sheets finished with image formation from the sheet output section 43 onto the sheet output tray 41. The widthwise directions of the image forming section 4 are the same as the widthwise directions 91 of the main apparatus 2.

The image forming section 4 is configured to carry out an electrophotographic image forming process for example. The image forming section 4 causes a recording sheet to bear thereon a toner image formed according to image data and then fixes the toner image onto the recording sheet by heat and pressure by means of a non-illustrated fixing device. The fixing device is disposed adjacent and below the sheet output section 43.

The operating device 10 is disposed on the front side of the main apparatus 2. In an exemplary arrangement, the operating device 10 is mounted on the front side of the image reading section 3. In an alternative exemplary arrangement, the operating device 10 is mounted at an opposite end portion in the widthwise directions 91 away from the first end portion at which the sheet output section 43 is disposed. Preferably, the operating device 10 and the sheet output section 43 are clear of each other in the widthwise directions 91.

The operating device 10 is free to pivot between a horizontal position shown in FIGS. 2A and 2B and a predetermined maximum inclined position on the front side. The operating device 10 is designed to maintain a desired angle of inclination in a desired inclined position shown in FIGS. 3A and 3B for example which is selected from the positions including the horizontal position, the maximum inclined position and one or more predetermined positions between the horizontal position and the maximum inclined position.

Figure 4:
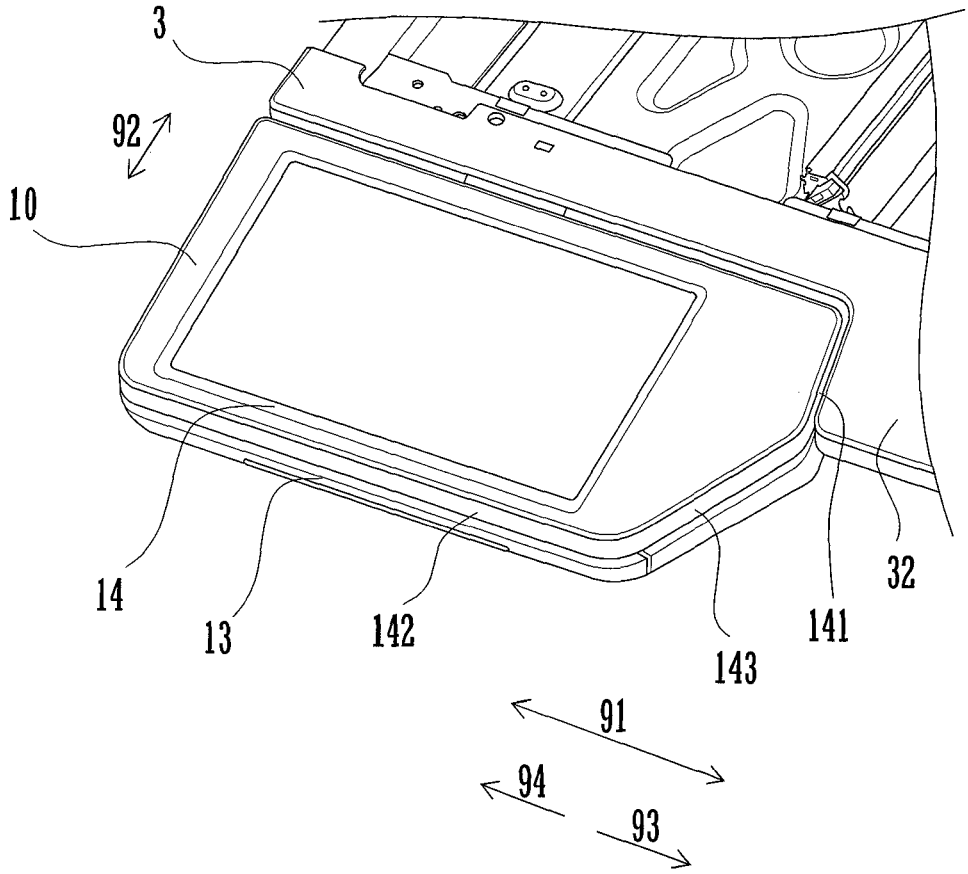
FIG. 4 is a perspective view of the operating device.

As shown in FIG. 4, the operating device 10 is mounted on a front surface of the image reading section 3. In an exemplary arrangement, an operating console 32 of the image reading section 3 is provided on the front surface of the image reading section 3 except the surface area occupied by the operating device 10. The operating console 32 forms a surface contiguous with the upper surface of the image reading section 3 and partially overlaps the operating device 10 in front-back directions 92 perpendicular to the widthwise directions 91 of the main apparatus 2.

Figure 5:
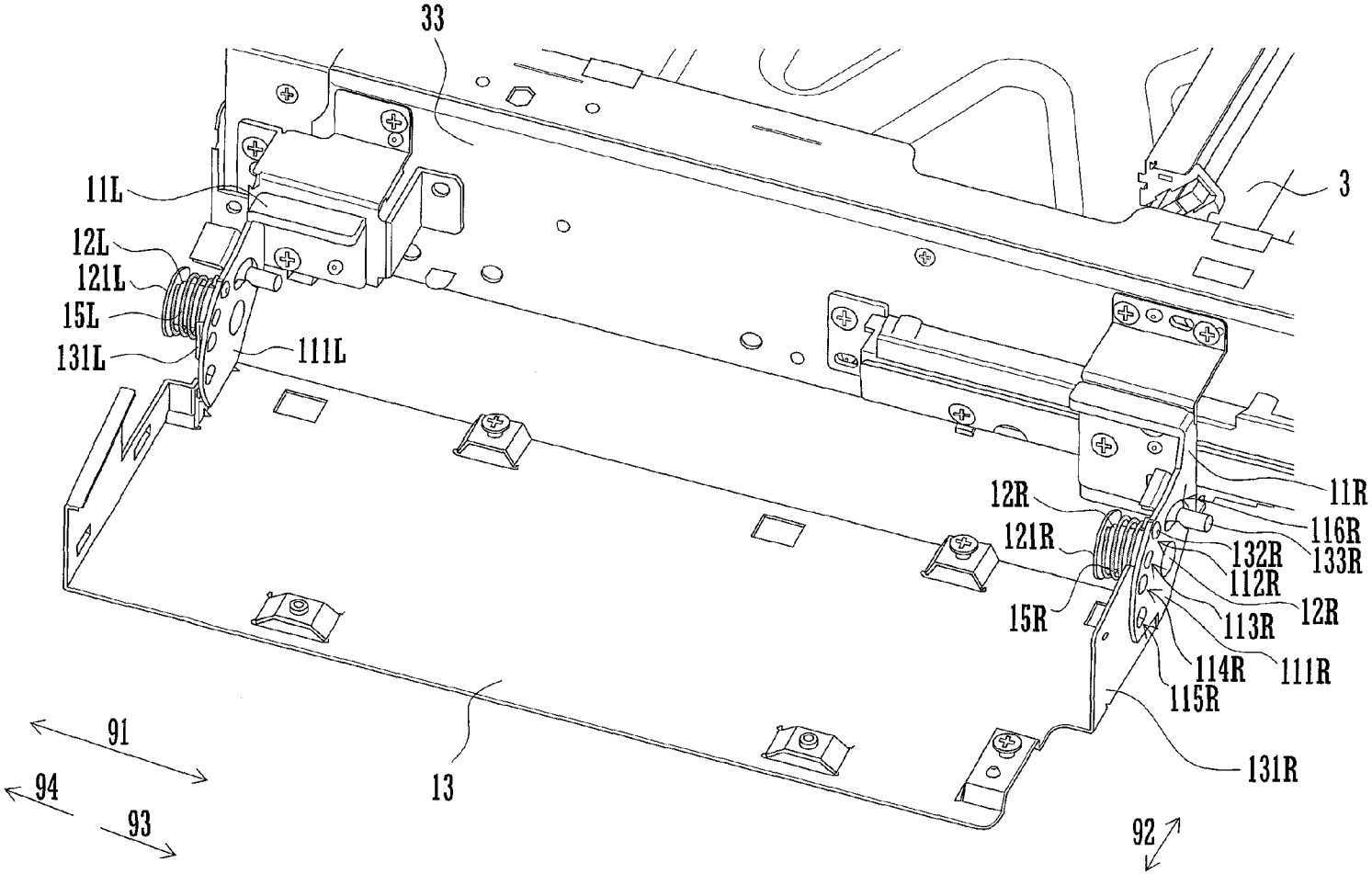
FIG. 5 is a perspective view illustrating the structure of the operating device except the operating panel.

As shown in FIG. 5, the operating device 10 includes first support frames 11R and 11L, support shafts 12R and 12L, a second support frame 13, an operating panel 14 (see FIG. 4), and springs 15R and 15L. The operating panel 14 is not shown in FIG. 5.

The widthwise directions 91 indicated in FIG. 5 include a first direction 93 toward the right-hand side as viewed from the side facing the front side of the main apparatus 2, and a second direction 94 opposite to the first direction 93.

The pair of first support frames 11R and 11L are spaced a predetermined distance apart from each other and fixed to a front surface of a scanner unit frame 33 of the image reading section 3 by means of screws for example. The first support frames 11R and 11L are provided with plate-shaped first support portions 111R and 111L, respectively, which extend in a direction which is perpendicular to the front surface of the scanner unit frame 33 and in a direction perpendicular to the horizontal direction.

The pair of support shafts 12R and 12L are supported by the respective first support portions 111R and 111L in such a manner as to project in one direction of the widthwise directions 91 from the respective first support portions 111R and 111L. The length of each of the support shafts 12R and 12L is several centimeters for example. In the present embodiment, the support shafts 12R and 12L are supported by the respective first support portions 111R and 111L in such a manner as to project in the second direction 94 of the widthwise directions 91 from the respective first support portions 111R and 111L.

The second support frame 13 includes plate-shaped second support portions 131R and 131L extending parallel with the first support portions 111R and 111L from the opposite ends of the rear edge portion of the second support frame 13 in the widthwise directions 91. The second support portions 131R and 131L each have a hole. By inserting the support shafts 12R and 12L into the respective holes, the second support frame 13 is pivotally supported on the support shafts 12R and 12L while being displaceable within a predetermined range in the widthwise directions 91. Therefore, the second support frame 13 is free to pivot about the support shafts 12R and 12L while being displaceable within the predetermined range in the widthwise directions 91. For this reason, the angle of inclination of the second support frame 13 can be varied by moving the front edge portion thereof up and down.

The operating panel 14 is supported by the second support frame 13. The operating panel 14 comprises a liquid crystal touch panel for example and is configured to receive entries of various control operations on the main apparatus 2 such as a copying operation and a facsimile operation. The angle of inclination of the operating panel 14 can be varied by pivoting the second support frame 13.

Figure 6:
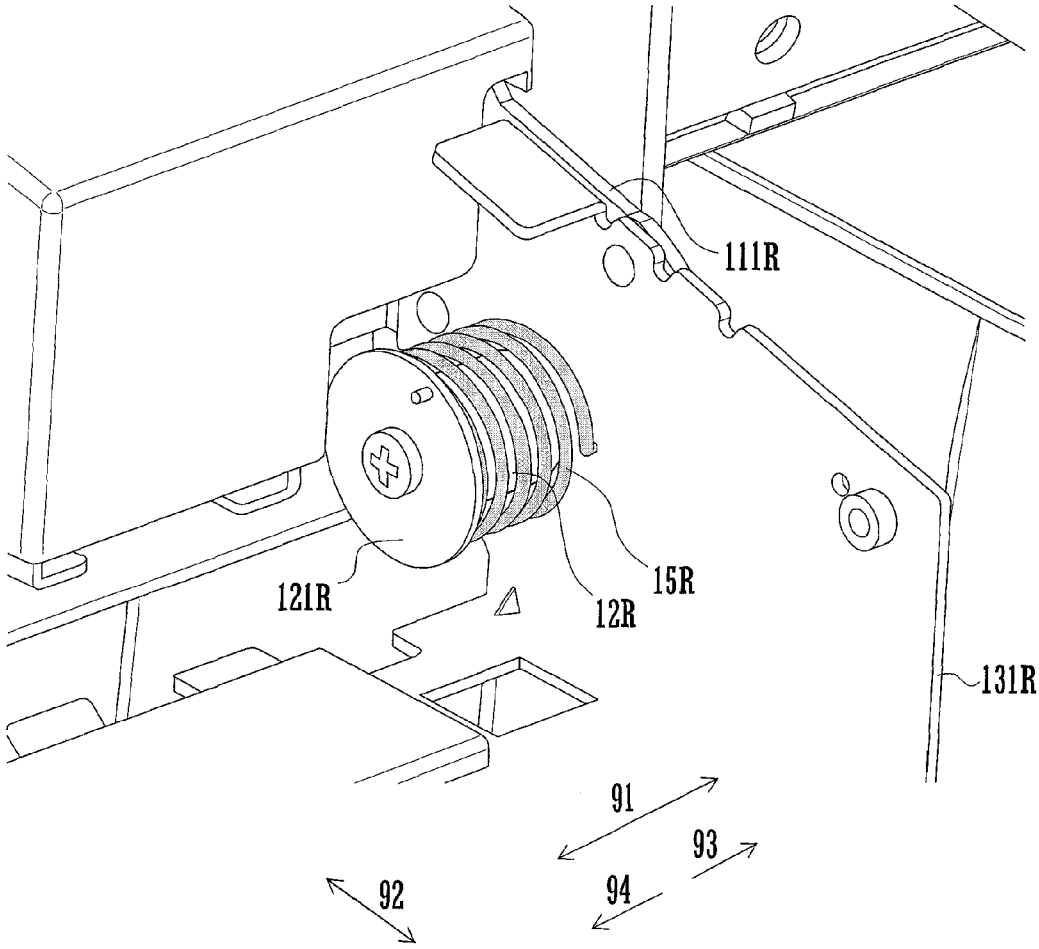
FIG. 6 is a partially enlarged perspective view of the structure of the operating device.

As shown in FIG. 6, the support shafts 12R and 12L are provided at their tips with spring fixing members 121R and 121L, respectively. In an exemplary arrangement, the spring fixing members 121R and 121L are disc-shaped having a larger diameter than the support shafts 12R and 12L and are screwed to the tips of the respective support shafts 12R and 12L.

The springs 15R and 15L each comprise a coil spring for example. The springs 15R and 15L are fitted over the support shafts 12R and 12L, respectively. The springs 15R and 15L are inserted between the spring fixing member 121R and the second support portion 131R and between the spring fixing member 121L and the second support portion 131L, respectively. The springs 15R and 15L exert an elastic force on the second support portions 131R and 131L in the first direction 93 in which the second support portions 131R and 131L are pressed against the first support portions 111R and 111L, respectively.

Each of the springs 15R and 15L has one end fixed to a respective one of the spring fixing members 121R and 121L and the other end fixed to a respective one of the second support portions 131R and 131L while exerting an upward elastic force on the second support frame 13. In an exemplary arrangement, each of the springs 15R and 15L has one end fixed to a respective one of the spring fixing members 121R and 121L by being inserted through a hole of the spring fixing member and the other end fixed to a respective one of the second support portions 131R and 131L by being inserted through a hole of the second support portion.

Description will be made of the mechanism for maintaining the angle of inclination of the second support frame 13. Note that the first support portion 111L has the same structure as the first support portion 111R. The second support portion 131L has the same structure as the second support portion 131R.

Figure 7:
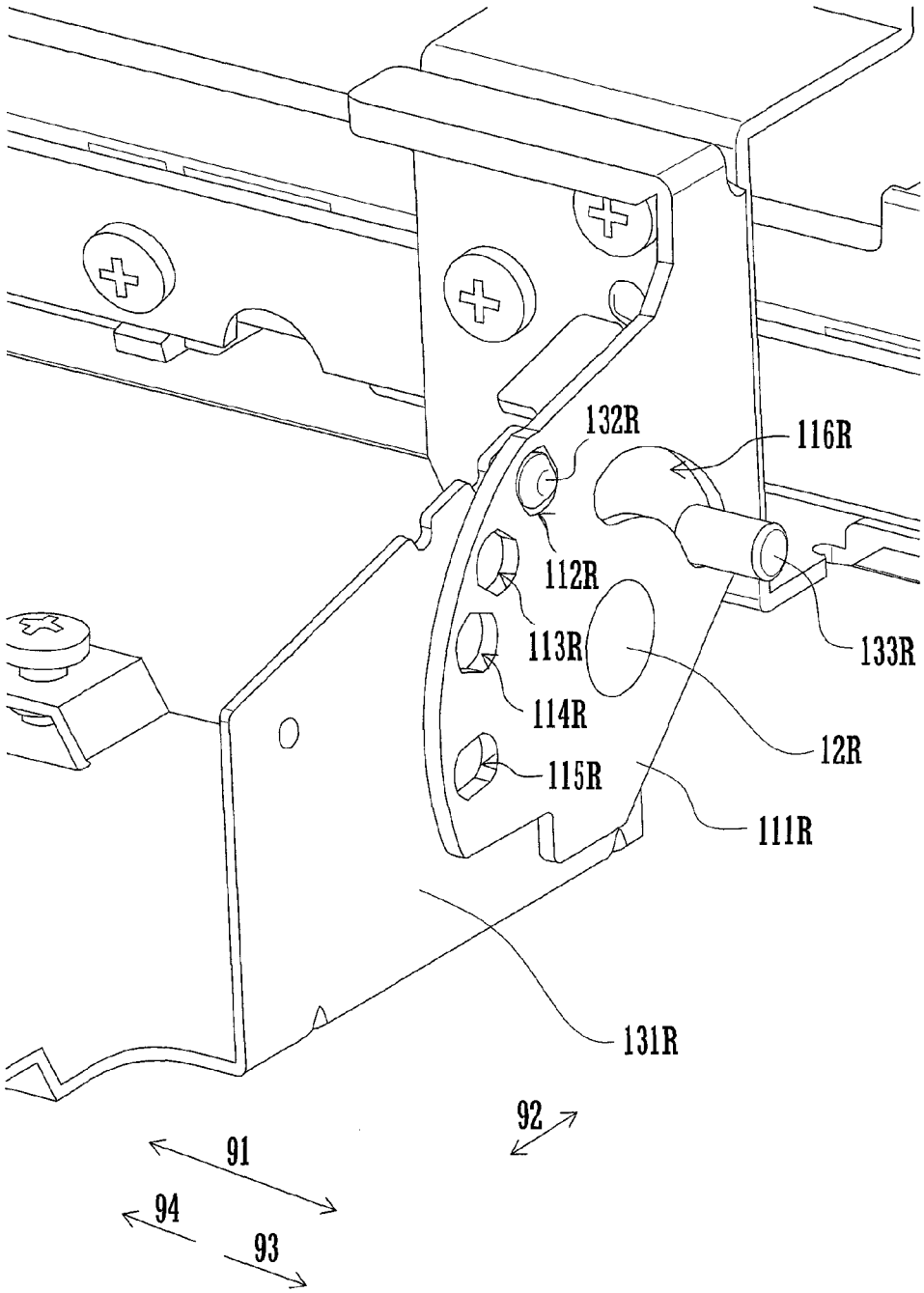
FIG. 7 is a partially enlarged perspective view of the structure of the operating device with the operating panel positioned horizontally.

As shown in FIG. 7, the first support portion 111R of the first support frame 11R has a plurality of recesses 112R, 113R, 114R and 115R on the circumference of a circle that is concentric with the support shaft 12R. Each of the recesses 112R to 115R comprises a through-hole for example, but may comprise a dent which fails to extend through the first support portion 111R. The first support portion 111R defines a slit 116R having a predetermined length which has an arc shape that is concentric with the support shaft 12R.

The second support portion 131R of the second support frame 13 has a surface pressed against the first support portion 111R which is provided with a first projection 132R for engagement into any one of the recesses 112R to 115R. The second support portion 131R has a second projection 133R which is displaceable within the slit 116R.

The angle of inclination of the second support frame 13 can be maintained by the following operations. Note that the operations including bringing the first support portion 111L and the second support portion 131L into engagement with each other and disengaging them from each other are similar to those for the first support portion 111R and the second support portion 131R.

The elastic force is exerted on the second support portion 131R in the first direction 93 in which the second support portion 131R is pressed against the first support portion 111R. Therefore, when the second support frame 13 is in an angular position to fit the first projection 132R into any one of the recesses 112R to 115R, the first projection 132R becomes engaged into that recess. When the first projection 132R is engaged into any one of the recesses 112R to 115R, the first projection of the second support portion 131L becomes engaged into a corresponding one of the recesses of the first support portion 111L. Thus, the angle of inclination of the second support frame 13 can be maintained by the engagement of the first projection 132R into any one of the recesses 112R to 115R and the engagement of the first projection of the second support portion 131L into the corresponding one of the recesses of the first support portion 111L.

On the other hand, the angle of inclination of the second support frame 13 can be varied by the following operations. That is, the first projection 132R is disengaged from any one of the recesses 112R to 115R by displacing the second support frame 13 in the second direction 94 against the elastic force of the spring 15R with one hand (e.g., right hand) of the user. Likewise, the first projection of the second support portion 131L is disengaged from a corresponding one of the recesses of the first support portion 111L. By so doing, the second support frame 13 becomes free to pivot.

By an operation including pivoting the second support frame 13 to a desired angle with the hand (e.g., right hand) while keeping the second support frame 13 displaced in the second direction 94 and then loosening the hand pressing the second support frame 13 in the second direction 94, the second support frame 13 is displaced in the first direction 93 by the elastic force of the spring 15R. By so doing, the first projection 132R is engaged into any desired one of the recesses 112R to 115R, thereby maintaining the second support frame 13 at a desired angle of inclination.

In this way, the series of operations for varying the angle of inclination of the second support frame 13, including disengaging the first projection 132R from any one of the recesses 112R to 115R, pivoting the second support frame 13, and engaging the first projection 132R into any desired one of the recesses, can be achieved with only one hand (e.g., right hand) holding the second support frame 13. Since the operations for varying the angle of inclination of the operating panel 14 can be achieved with one hand, the operating device 10 of the present embodiment offers improved operability.

Since the upward elastic force is exerted on the second support frame 13, downward displacement of the second support frame 13 by its own weight and the weight of the operating panel 14 can be suppressed even when the first projection 132R is disengaged from any one of the recesses 112R to 115R, with the result that the operation to pivot the second support frame 13 becomes easy.

Though the second projection 133R turns with pivoting movement of the second support frame 13, the turning movement of the second projection 133R is restricted by the slit 116R and, hence, the pivoting of the second support frame 13 is restricted within a predetermined range. For this reason, even when the second support frame 13 pivots against the intention of the user for the reason that the user's hand slips off the second support frame 13 or a like reason, the second support frame 13 can be prevented from colliding with the main apparatus 2, thereby preventing damage to the main apparatus 2, the operating panel 14, or the like.

As shown in FIG. 4, the operating panel 14 is shaped to have an inclined edge 143, a side edge 141 on the downstream side in the first direction 93, and a front edge 142, the inclined edge 143 forming an obtuse angle with each of the side edge 141 and the front edge 142. The second support frame 13 is shaped similar in plan view to the operating panel 14.

The inclined edge 143 of the operating panel 14 and the inclined edge of the second support frame 13 are provided to form a shape which seems as if it resulted from chamfering the corner formed between the side edge 141 on the downstream side in the first direction 93 and the front edge 142. Such a shape allows the user to hold the operating panel 14 and the second support frame 13 easily.

Preferably, the operating device 10 is disposed at a place on an upstream side of which in the first direction 93 the main apparatus 2 is absent, as shown in FIGS. 1 and 4.

In cases where the main apparatus 2 is present on the upstream side of the operating device 10 in the first direction 93, the operating console 32 of the main apparatus 2 has to be formed with a cutout portion for providing a space which enables the second support frame 13 to be displaced in the second direction 94. When the operating console 32 is formed with such a cutout portion, the cutout portion needs to be provided with a cover in order to prevent the user from being caught on the cutout portion and improve the aesthetic design. By contract, when the main apparatus 2 is absent on the upstream side of the operating device 10 in the first direction 93, the main apparatus 2 does not need to be formed with the cutout portion for providing the space which enables the second support frame 13 to be displaced in the second direction 94. Therefore, it is possible to prevent the parts count and the manufacturing cost from increasing.

In an exemplary arrangement, the operating device 10 is disposed at an end portion of the main apparatus 2 on the upstream side in the first direction 93. With this arrangement, the upstream-side end portion of the main apparatus 2 and the upstream-side end portion of the operating device 10 are aligned with each other in the first direction 93, which makes designing and assembling operations easy.

Figure 9:
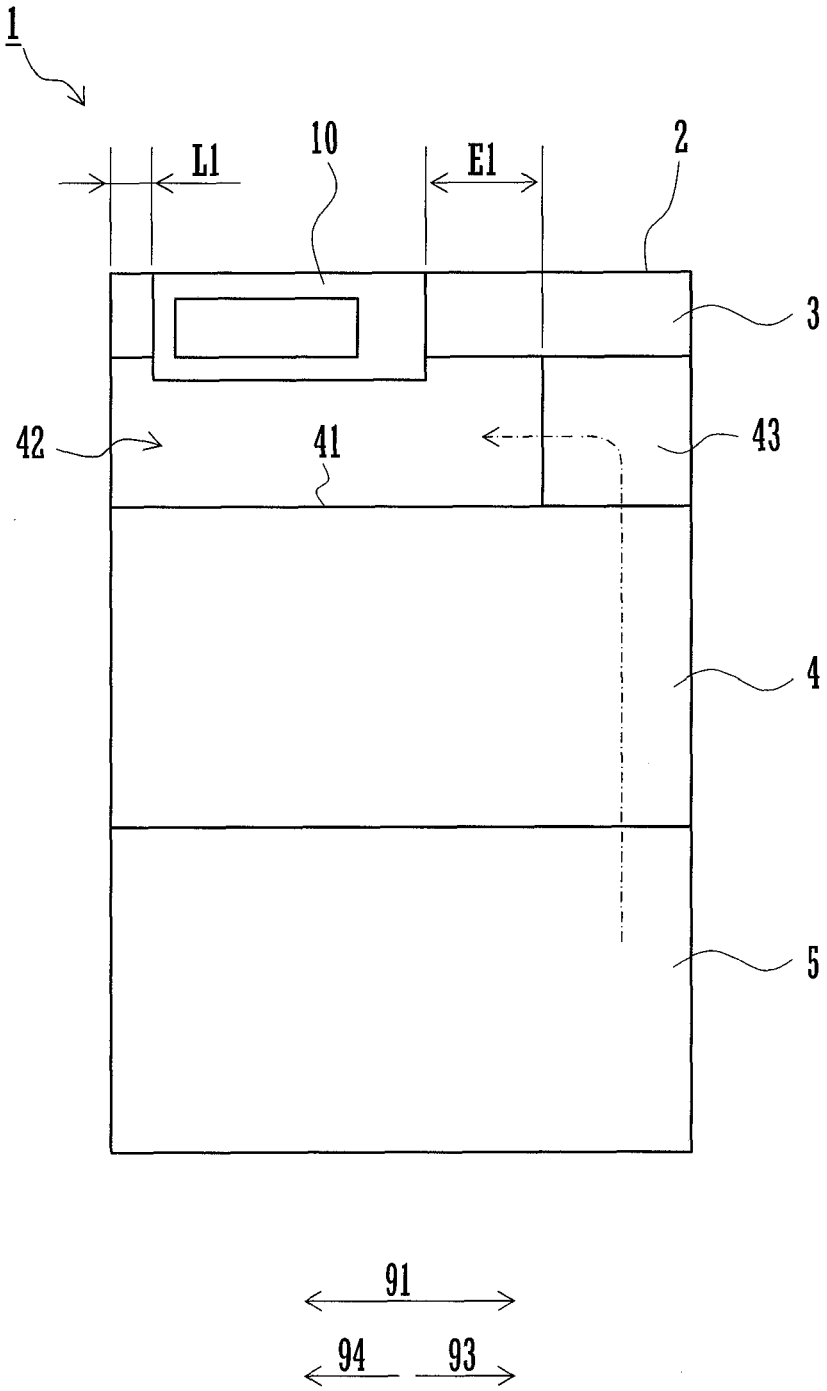
FIG. 9 is a schematic front elevational view of the image forming apparatus for illustrating the position of the operating device relative to the main apparatus.

In another exemplary arrangement as shown in FIG. 9, the upstream-side end portion of the operating device 10 may be spaced downstream from the upstream-side end portion of the main apparatus 2 in the first direction 93 by at least a distance L1 which is equal to the displaceable range of the second support frame 13 in the widthwise directions 91.

Since the upstream-side end portion of the operating device 10 is spaced from the upstream-side end portion of the main apparatus 2 in the first direction 93 by the distance L1 which is equal to the displaceable range of the second support frame 13 in the widthwise directions 91, the operating panel 14 fails to project upstream of the main apparatus 2 in varying the angle of inclination of the operating panel 14. For this reason, even when the image forming apparatus 1 is installed in such a manner that its upstream-side surface in the first direction 93 abuts against a wall surface of the installation place, the angle of inclination of the operating panel 14 can be varied easily.

Preferably, the operating device 10 is disposed opposite away from the sheet output section 43 in the widthwise directions 91. The sheet output section 43 has an exterior member which is openable for ease of maintenance such as elimination of a paper jam. With the arrangement in which the operating device 10 is disposed opposite away from the sheet output section 43 in the widthwise directions 91, there is no need to make designs taking the mechanism of the sheet output section 43 and heat generated by the fixing device located adjacent the sheet output section 43 into consideration. Thus the image forming apparatus 1 has an enhanced design freedom.

The operating device 10 does not need to be provided at a lower portion thereof with a projecting portion for locking and unlocking the second support frame 13 such as a locking lever and hence can be downsized. For this reason, it becomes easy to check and remove recording sheets having been outputted onto the sheet output tray 41 in the image forming apparatus 1 of the in-body output type.

In the image forming apparatus 1 of the in-body output type, the end portion of the operating device 10 which is located on the downstream side in the first direction 93 is preferably located upstream of the upstream-side end portion of the sheet output section 43. With this arrangement, the user can have access to the sheet output tray 41 through the region intervening between the downstream-side end portion of the operating device 10 and the upstream-side end portion of the sheet output section 43, so that the user is allowed to easily check and remove recording sheets having been outputted onto the sheet output tray 41.

Figure 8:
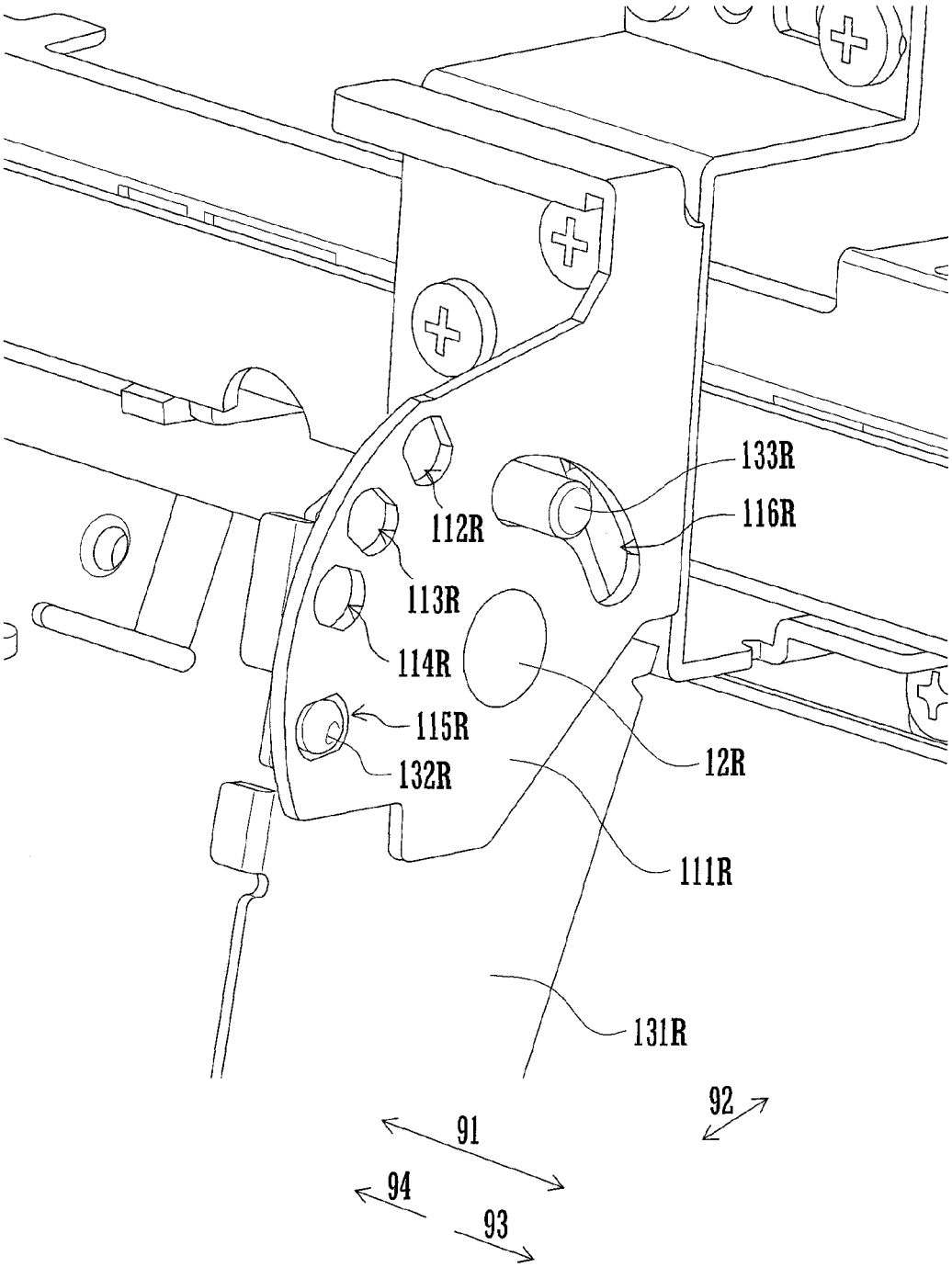
FIG. 8 is a partially enlarged perspective view of the structure of the operating device with the operating panel positioned at a maximum angle of inclination.

With the image forming apparatus 1, the angle of inclination of the operating panel 14 can be varied to an angle desired by the user in accordance with the standing position of the user and the height of the user's eyes. When the operating panel 14 assumes the maximum inclined position as shown in FIG. 8, the amount of projection of the operating device 10 relative to the main apparatus 2 can be reduced. Therefore, in moving the image forming apparatus 1 it can pass through even a narrow passage easily and, hence, the moving operation is easy. Further, a packing material for packing the image forming apparatus 1, such as a box, can be reduced in size, with the result that the space to be occupied by the image forming apparatus 1 during storage and transportation can be reduced.

The operating device 10 may be provided with only one of the springs 15R and 15L. Though the operating device 10 is provided with two combinations of recesses 112R to 115R and first projection 132R in total, one combination being provided at each of the opposite ends of the second support frame 13 in the widthwise directions 91, the operating device 10 may be provided with only one such combination. Similarly, though the operating device 10 is provided with two combinations of slit 116R and second projection 133R in total, one combination being provided at each of the opposite ends of the second support frame 13 in the widthwise directions 91, the operating device 10 may be provided with only one such combination.

The inclined edge 143 may form an obtuse angle with each of a side edge of the operating panel 14 on the upstream side in the first direction 93 and the front edge 142.

The springs 15, which form an exemplary elastic member, may be replaced with rubber members.

The operating device 10 may be constructed under the condition that the first direction 93 of the widthwise directions 91 is a direction toward the left-hand side as viewed from the side facing the front side of the main apparatus 2 while the second direction 94 is a direction opposite to the first direction 93.

The operating device 10 may be mounted on any information processing apparatus other than the image forming apparatus 1. In this case also, the operating device 10 can exercise the effect of enabling the user to vary the angle of inclination of the operating panel with one hand.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. An operating device comprising:

a first support frame fixed to a front side of a main apparatus;

an axis portion mounted on the first support frame;

an operating panel configured to receive an entry of an operation for controlling the main apparatus;

a second support frame that supports the operating panel, and which is pivotally supported on the axis portion in such a manner as to be displaceable with the operating panel within a predetermined range in a widthwise direction of the main apparatus while supporting the operating panel; and an elastic member disposed between the first support frame and the second support frame and exerting an elastic force on the second support frame in a first direction in which the second support frame is pressed against the first support frame, the first support frame and the second support frame having a fitting portion with which the first support frame and the second support frame are fit into each other, the operating panel pivoting on the axis portion with the second support frame when the operating panel is displaced with the second support frame in the widthwise direction of the main apparatus and the fitting in the fitting portion is released.

2. The operating device according to claim 1, wherein the elastic member exerts an upward elastic force on the second support frame in addition to the elastic force in the first direction.

3. The operating device according to claim 1, wherein:

one of the first support frame and the second support frame further has a slit having a predetermined length which has an arc shape that is concentric with the support shaft; and the other of the first support frame and the second support frame further has a second projection which is displaceable within the slit.

4. The operating device according to claim 1, wherein:

the operating panel is shaped to have an inclined edge, a side edge on a downstream side in the first direction, and a front edge, the inclined edge forming an obtuse angle with each of the side edge and the front edge; and the second support frame is shaped similar to the operating panel.

5. An image forming apparatus comprising:

the operating device according to claim 1; and a main apparatus including an image reading section configured to carry out an image reading process for reading an image from a document to generate image data, and an image forming section disposed under the image reading section for performing image formation on a recording medium, the image forming section being formed with a sheet output section at a first end portion thereof in a widthwise direction of the image forming section in such a manner as to leave a space under the image reading section for accommodating therein a sheet output tray configured to receive a recording medium finished with image formation, the operating device being mounted at an end portion of the image reading section which is opposite away from the first end portion in the widthwise direction of the main apparatus.

6. The image forming apparatus according to claim 5, wherein a downstream-side end portion of the operating device is located upstream of an upstream-side end portion of the sheet output section in the first direction.

7. The operating device according to claim 1, wherein:

the fitting portion includes a plurality of fitting portions that include a recess and a first projection which fits into the recess, one of the first support frame and the second support frame includes a plurality of the recesses on a circumference of a circle that is concentric with the axis portion, and the other of the first support frame and the second support frame includes the first projection.

8. An image forming apparatus comprising a main apparatus and an operating device, the main apparatus including an image reading section on top of the main apparatus, the operating device including:

a first support frame fixed to a front side of the main apparatus;

an axis portion mounted on the first support frame;

an operating panel configured to receive an entry of an operation for controlling the main apparatus;

a second support frame that supports the operating panel, and which is pivotally supported on the axis portion in such a manner as to be displaceable with the operating panel within a predetermined range in a widthwise direction of the main apparatus while supporting the operating panel; and an elastic member disposed between the first support frame and the second support frame and exerting an elastic force on the second support frame in a first direction in which the second support frame is pressed against the first support frame, wherein:

the first support frame and the second support frame have a fitting portion with which the first support frame and the second support frame are fit into each other; the operating panel pivots on the axis portion when the operating panel is displaced in the widthwise direction of the main apparatus and the fitting in the fitting portion is released, and the operating device is mounted on a front surface of the image reading section, provided with an operating console of the image reading section on the front surface of the image reading section, the operating console forming a surface contiguous with an upper surface of the image reading section and partially overlapping the operating device in front-back directions perpendicular to the widthwise direction of the main apparatus on a downstream side of the operating device in the first direction.

9. The image forming apparatus according to claim 8, wherein the operating panel is shaped to have an inclined edge, a side edge on a downstream side in the first direction, and a front edge, the inclined edge forming an obtuse angle with each of the side edge and the front edge; and a rear end of the inclined edge is shaped similar to a front end of the operating console in the front-back directions.

* * * * *